US012258816B2

(12) United States Patent
Reddy et al.

(10) Patent No.: US 12,258,816 B2
(45) Date of Patent: Mar. 25, 2025

(54) SIDE SADDLE TRAVERSABLE DRILLING RIG

(71) Applicant: NABORS DRILLING TECHNOLOGIES USA, INC., Houston, TX (US)

(72) Inventors: Padira Reddy, Richmond, TX (US); Denver Lee, Houston, TX (US); Premkumar Mongattil, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 18/535,519

(22) Filed: Dec. 11, 2023

(65) Prior Publication Data

US 2024/0102345 A1 Mar. 28, 2024

Related U.S. Application Data

(63) Continuation of application No. 17/460,031, filed on Aug. 27, 2021, now Pat. No. 11,873,685.

(60) Provisional application No. 63/073,197, filed on Sep. 1, 2020.

(51) Int. Cl.

| | |
|---|---|
| ***E21B 15/00*** | (2006.01) |
| ***E21B 7/02*** | (2006.01) |
| ***E21B 19/14*** | (2006.01) |

(52) U.S. Cl.

CPC ..... *E21B 15/003* (2013.01); *E21B 7/023* (2013.01); *E21B 15/006* (2013.01); *E21B 19/14* (2013.01)

(58) Field of Classification Search

CPC ..... E21B 15/003; E21B 7/023; E21B 15/006; E21B 19/14; E21B 15/00; E21B 7/02; E04H 12/34; E04H 12/18; E04H 12/182

See application file for complete search history.

(56) References Cited

U.S. PATENT DOCUMENTS

| | | | |
|---|---|---|---|
| 10,519,727 | B2 | 12/2019 | Orr et al. |
| 10,844,674 | B2 | 11/2020 | Berry et al. |
| 12,054,993 | B2 | 8/2024 | Patterson |

(Continued)

FOREIGN PATENT DOCUMENTS

| | | | |
|---|---|---|---|
| CO | NC20180005788 | A1 | 8/2018 |
| RU | 2420646 | C2 | 6/2011 |

(Continued)

OTHER PUBLICATIONS

Office Action issued in Colombian App. No. NC2023/0002077, dated Oct. 30, 2024, with English translation thereof (36 pages).

(Continued)

*Primary Examiner* — Babajide A Demuren

(74) *Attorney, Agent, or Firm* — EWING & JONES, PLLC

(57) ABSTRACT

A land-based drilling rig includes a drill rig floor and a subfloor, the subfloor supporting the drill rig floor. The land-based drilling rig also includes a plurality of substructure boxes, the substructure boxes supporting the subfloor, each substructure box including a lower substructure box and two upper substructure boxes, wherein there is a gap between the two upper substructure boxes. In addition, the land-based drilling rig further includes a mast, the mast mechanically coupled to the drill rig floor.

14 Claims, 9 Drawing Sheets

(56) References Cited

U.S. PATENT DOCUMENTS

| | | | | |
|---|---|---|---|---|
| 2013/0327543 | A1* | 12/2013 | Reddy | E21B 19/14 166/85.1 |
| 2016/0060979 | A1 | 3/2016 | Magnuson | |
| 2016/0326817 | A1 | 11/2016 | Orban | |
| 2017/0081924 | A1* | 3/2017 | Smith | B62D 57/02 |
| 2017/0107735 | A1* | 4/2017 | Wasterval | E04H 12/34 |
| 2018/0245408 | A1 | 8/2018 | Keogh et al. | |
| 2019/0003271 | A1 | 1/2019 | Clarke et al. | |
| 2019/0145194 | A1 | 5/2019 | Berry et al. | |
| 2020/0040673 | A1 | 2/2020 | Donnally et al. | |

FOREIGN PATENT DOCUMENTS

| | | |
|---|---|---|
| RU | 2576749 C2 | 3/2016 |
| RU | 2663850 C1 | 8/2018 |

OTHER PUBLICATIONS

Office Action issued in Russian App. No. 2023102794, dated Nov. 18, 2024, with English translation thereof (18 pages).
Office Action issued in SA App. No. 122430822 dated Aug. 28, 2024 and translation thereof (12 pages).

* cited by examiner

SIDE SADDLE TRAVERSABLE DRILLING RIG

CROSS-REFERENCE TO RELATED APPLICATIONS

This application is a continuation application which claims priority from U.S. utility application Ser. No. 17/460,031 filed Aug. 27, 2021 which is itself a nonprovisional application which claims priority from U.S. provisional application No. 63/073,197, filed Sep. 1, 2020, each of which is hereby incorporated by reference herein in its entirety.

FIELD OF THE DISCLOSURE

The present disclosure relates generally to drilling rigs, and specifically to drilling rig structures for land drilling in the petroleum exploration and production industry.

BACKGROUND OF THE DISCLOSURE

Land-based drilling rigs may be configured to move from location to location to drill multiple wells within a wellsite. It is often desirable to move the land-based drilling rig across an already drilled well within the wellsite for which there is a well-head in place. Further, mast placement on land-based drilling rigs may have an effect on drilling activity. For example, depending on mast placement on the drilling rig, an existing well head may interfere with the location of land-situated equipment such as, for example, existing well heads and may also interfere with raising and lowering of equipment needed for operations.

SUMMARY

The present disclosure provides for a land-based drill rig. The land-based drilling rig includes.

BRIEF DESCRIPTION OF THE DRAWINGS

The summary and the detailed description are further understood when read in conjunction with the appended drawings. For the purpose of illustrating the present disclosure, there are shown in the drawings exemplary embodiments of said disclosure; however, the disclosure is not limited to the specific methods, compositions, and devices disclosed. In addition, the drawings are not necessarily drawn to scale. In the drawings.

DETAILED DESCRIPTION

The present disclosure may be understood more readily by reference to the following detailed description, taken in connection with the accompanying figures, which form a part of this disclosure. It is to be understood that this disclosure is not limited to the specific devices, methods, applications, conditions or parameters described and/or shown herein, and that the terminology used herein is for the purpose of describing particular embodiments by way of example only and is not intended to be limiting of the present disclosure. Also, as used in the specification, including the appended claims, the singular forms "a," "an," and "the" include the plural, and reference to a particular numerical value includes at least that particular value, unless the context clearly dictates otherwise. The term "plurality," as used herein, means more than one.

Figure 1:
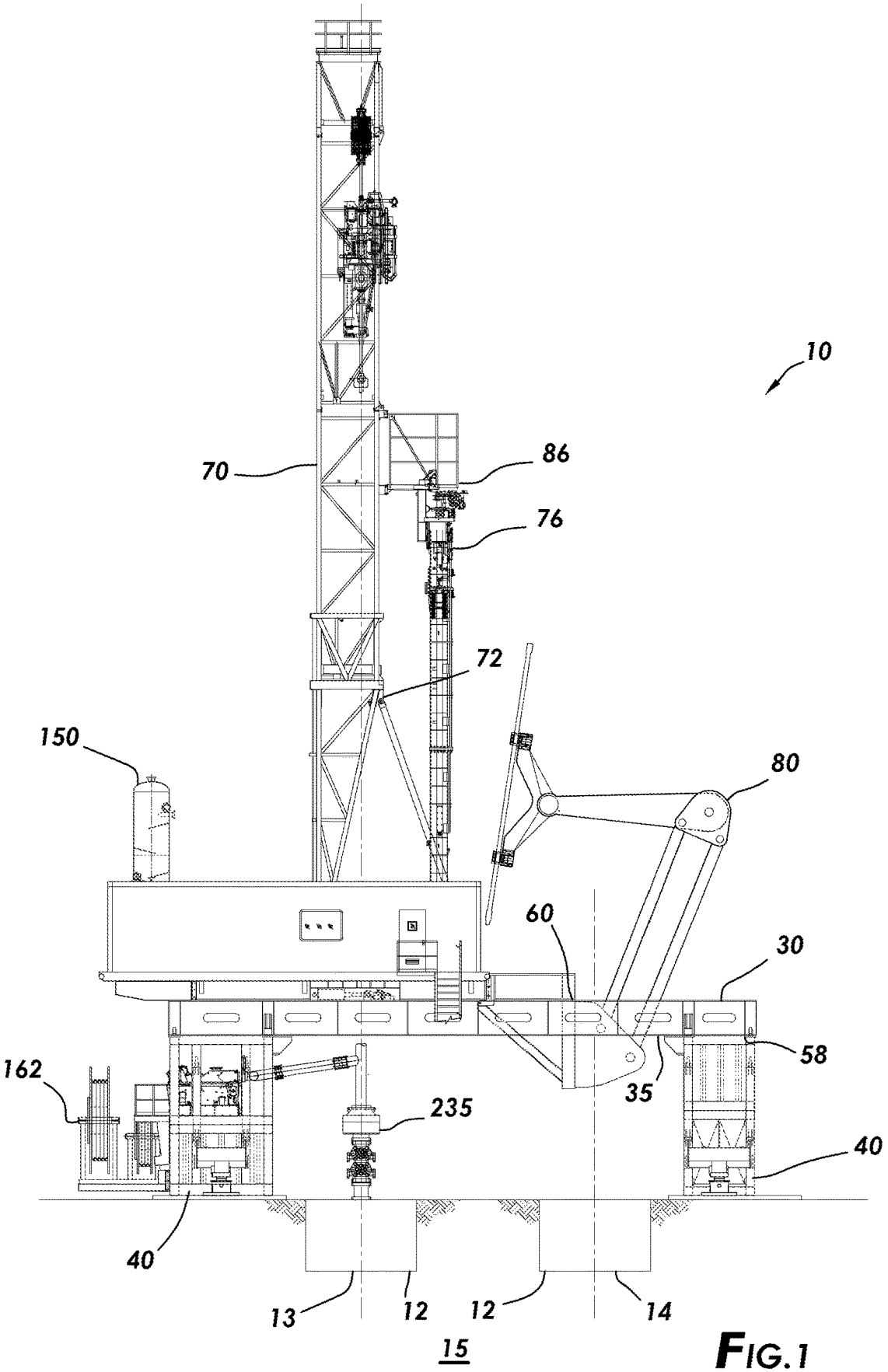
FIG. 1 is a driller's side elevation view of a land-based drilling rig consistent with at least one embodiment of the present disclosure.
Figure 2:
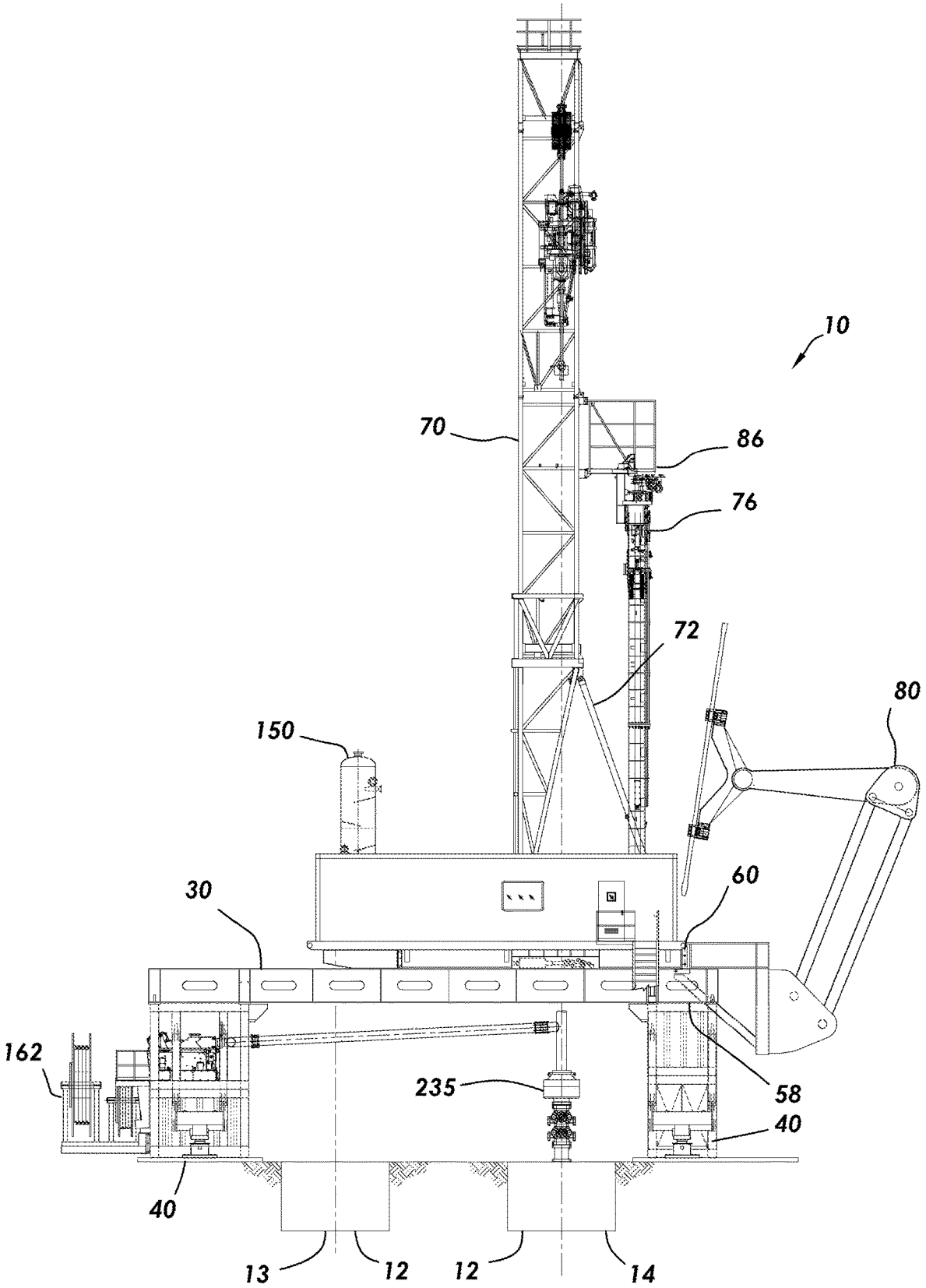
FIG. 2 is a driller's side elevation view of a land-based drilling rig consistent with at least one embodiment of the present disclosure.
Figure 3:
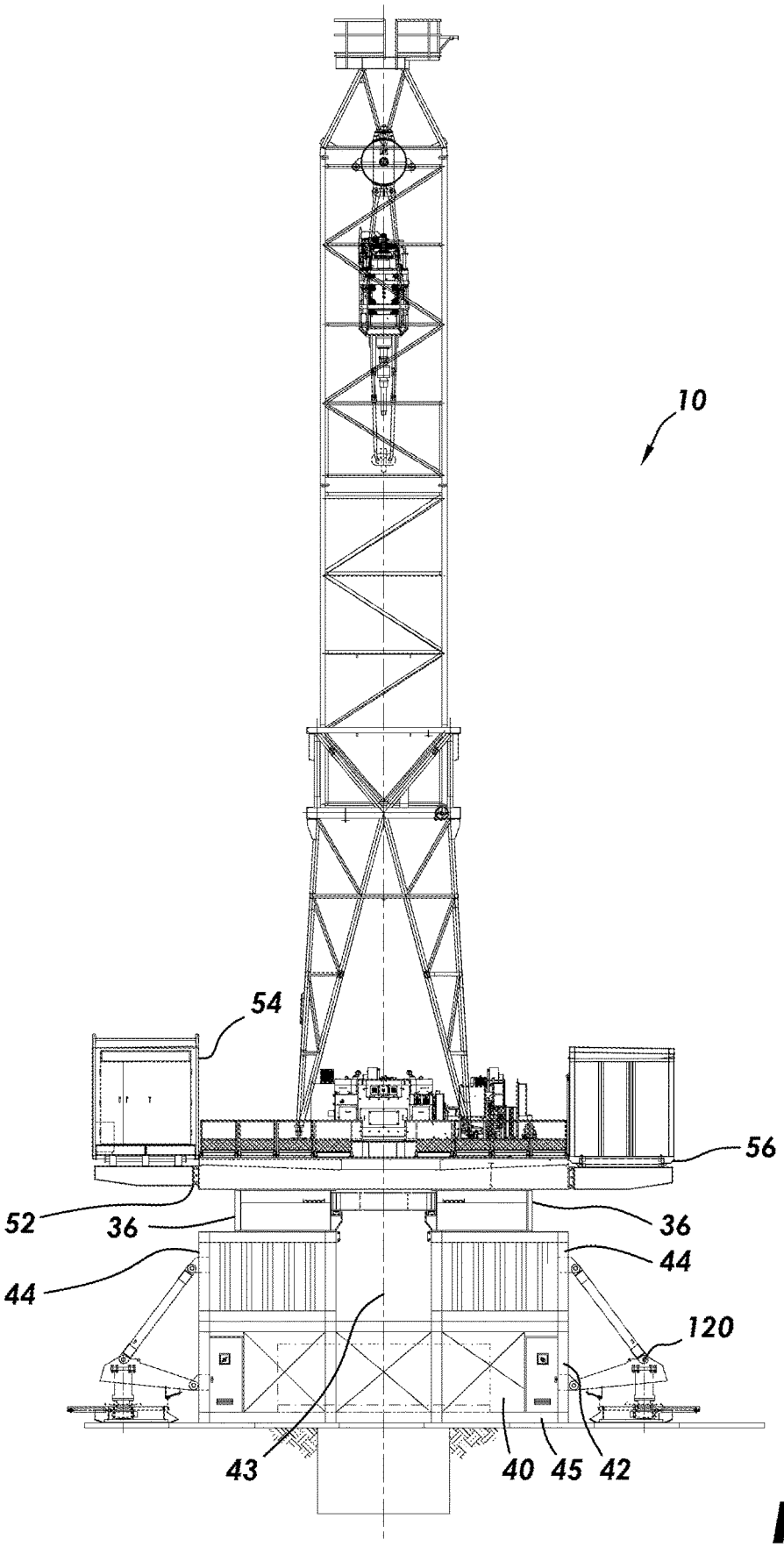
FIG. 3 is a V-Door side elevation of a land-based drilling rig consistent with at least one embodiment of the present disclosure.
Figure 4:
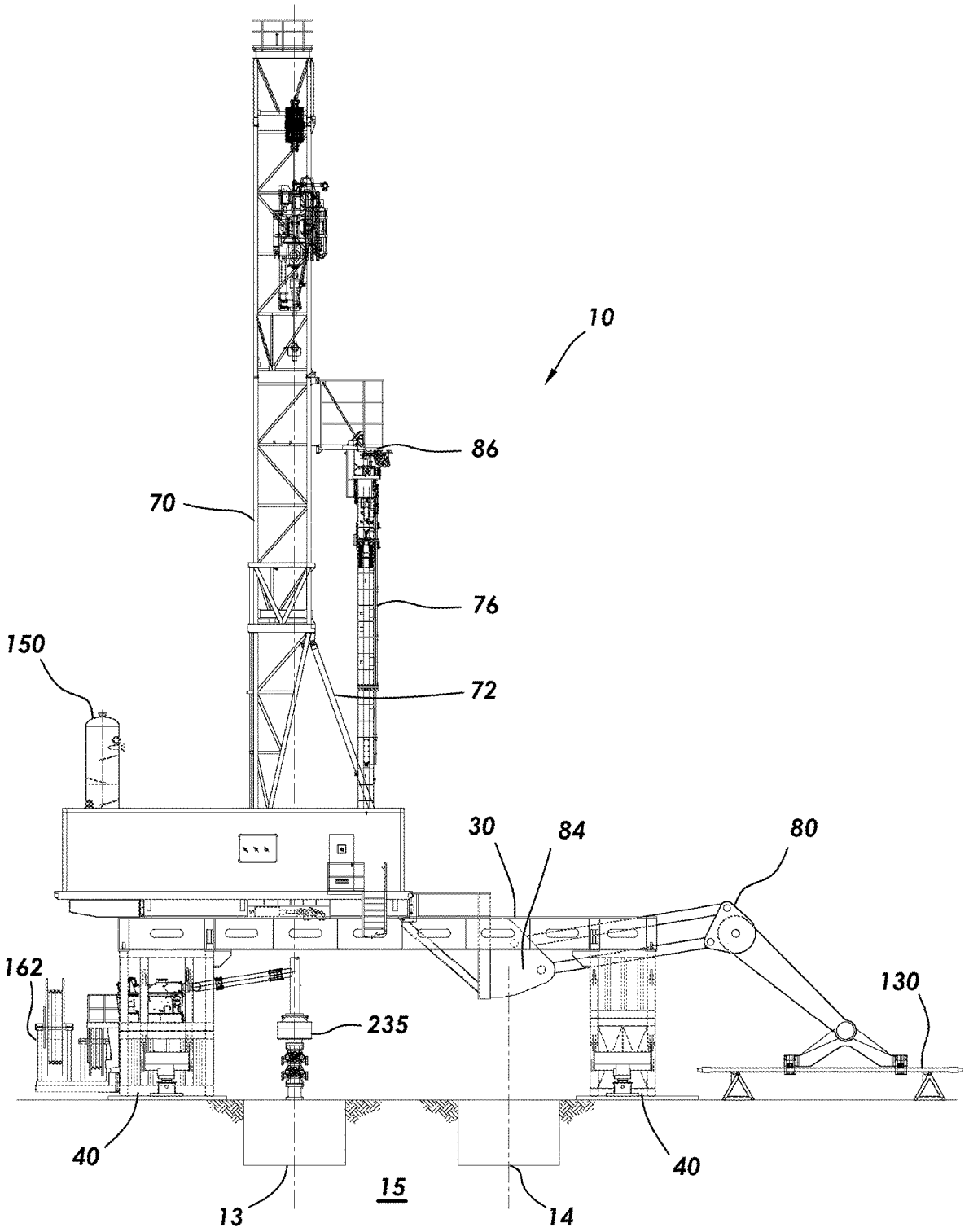
FIG. 4 is a side elevation of a land-based drilling rig consistent with at least one embodiment of the present disclosure.
Figure 5:
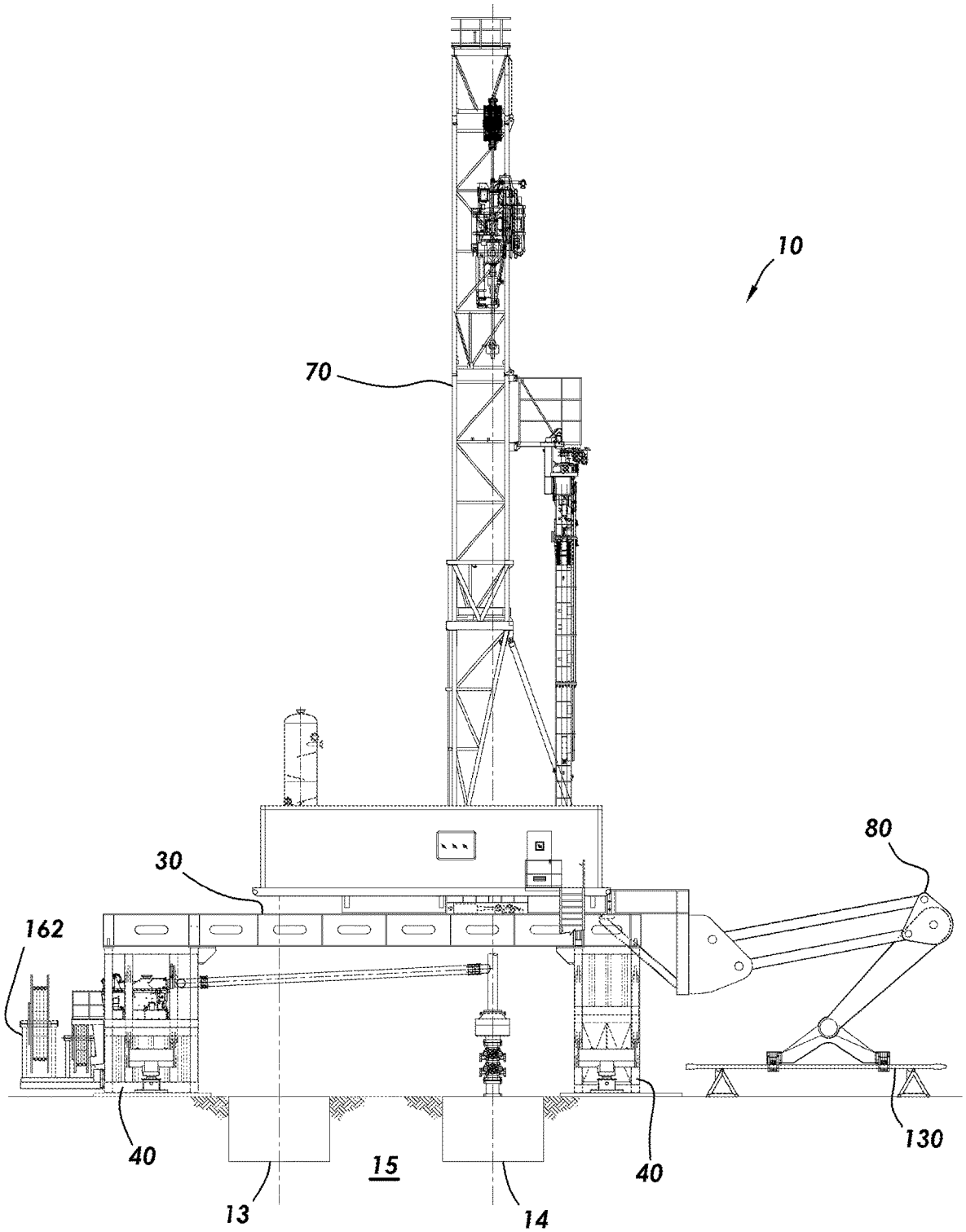
FIG. 5 is a side elevation of a land-based drilling rig consistent with at least one embodiment of the present disclosure.

FIGS. 1-3 are perspective views of land-based drilling rig 10 consistent with at least one embodiment of the present disclosure. Land-based drilling rig 10 may include drill rig floor 30 supported by subfloor 35. In turn, subfloor 35 may be supported by substructure boxes 40. Drill rig floor 30 includes driller's side 52, on which driller's cabin 54 may be positioned or cantilevered from, and off-driller's side 56, which is the side of drill rig floor 30 opposite driller's cabin 54. Drill rig floor 30 may be further defined by V-door side 58, having V-door or opening 60 positioned thereon.

Mast 70 may be fixedly or pivotably coupled to drill rig floor 30. Mast 70 may include mast V-door side 72, which faces drilling rig V-door side 58. Mast V-door side 72 may be an open side of mast 70. Equipment attached to mast 70 may include racking board 86 and racker 76.

Figure 8:
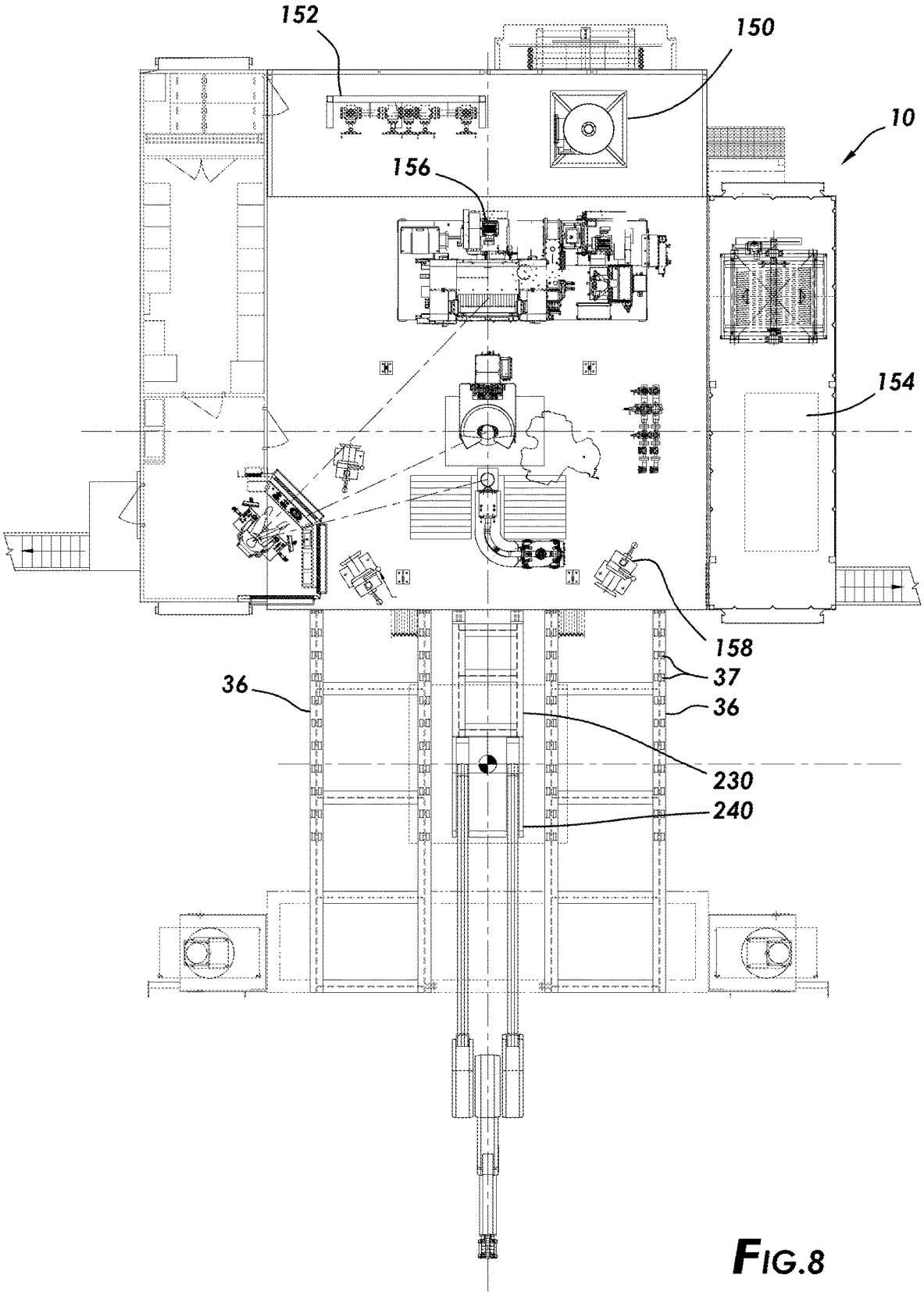
FIG. 8 is a plan view at drill floor level of a land-based drilling rig consistent with at least one embodiment of the present disclosure.
Figure 9:
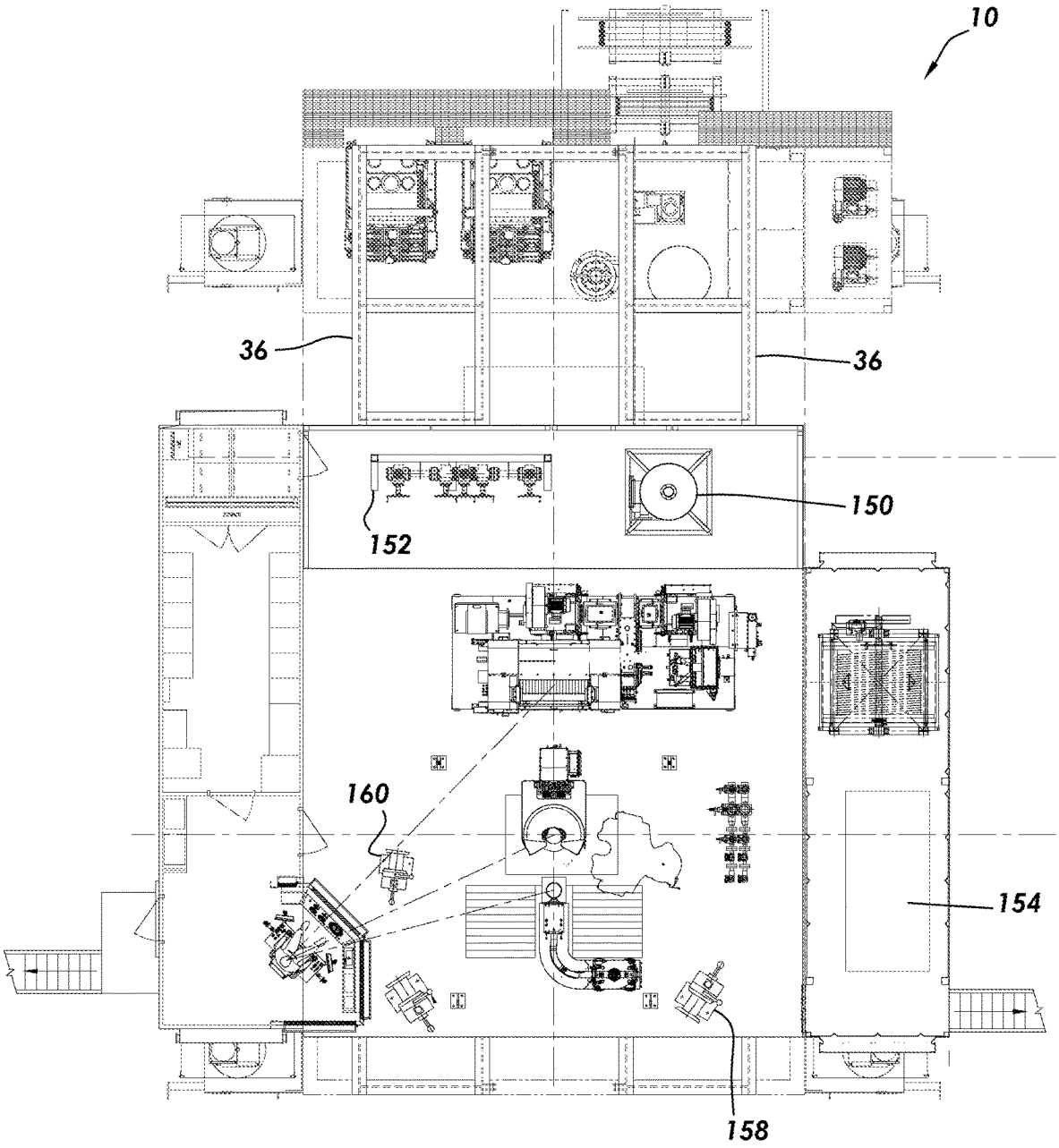
FIG. 9 is a plan view at drill floor level of a land-based drilling rig consistent with at least one embodiment of the present disclosure.

As shown in FIGS. 3, 8, and 9, in an embodiment, subfloor 35 may include a plurality of beams 36. Beams 36 may include rollers 37 affixed thereto, positioned between beams 36 of subfloor 35 and drill rig floor 30. In other embodiments, rollers are not present. In some embodiments, a hydraulic cylinder is used to push drill rig floor 30 relative to subfloor 35. As one of ordinary skill in the art with the benefit of this disclosure will appreciate, any movement method suitable to move drill rig floor 30 relative to subfloor 35 may be used. Thus, drill rig floor 30 may be adapted to traverse atop subfloor 35 such that mast 70 is positioned above right cellar 14 or left well cellar 13.

Figure 6:
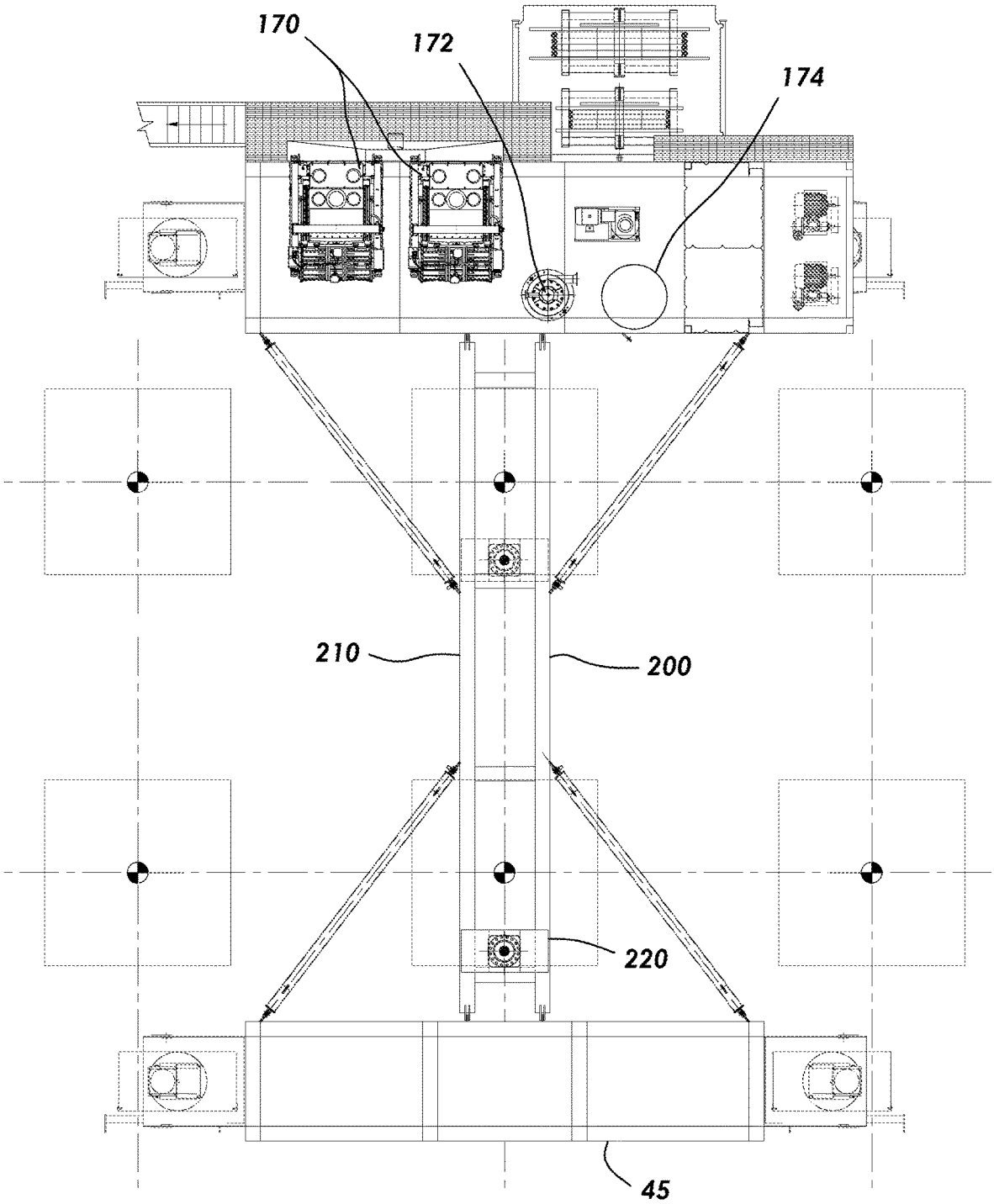
FIG. 6 is a plan view of a land-based drilling rig at sub-box level consistent with at least one embodiment of the present disclosure.

In certain embodiments, subfloor 35 may be positioned so as to span multiple well cellars 12. Well cellars 12, as used herein, are defined as locations in wellsite 15 at which one or more wells are positioned and may include a trench or otherwise dug-out area around the wells of each well cellar 12. For example, as shown in FIGS. 1, 2, 4, and 5, wellsite 15 may include left well cellar 13 and right well cellar 14. Leftmost substructure box 40 may be positioned to the left of left well cellar 13 and rightmost substructure box 40 may be positioned to the right of right well cellar 14. Thus, drill rig floor 30 may traverse between a position aligned with left well cellar 13 and a position aligned with right well cellar 14. Although shown as spanning two well cellars 12, subfloor 35 may span one or more well cellars 12 within the scope of this disclosure. In certain embodiments, additional well cellars, as shown in FIG. 6, may extend in rows perpendicular to beams 36 of subfloor 35 aligned with left well cellar 13 and/or right well cellar 14.

In some embodiments, substructure boxes 40 may each include lower substructure box 42 and upper substructure boxes 44. Lower substructure box 42 may extend the length of or a portion of the length of subfloor 35. Lower substructure box 42 may be rectangular prisms having long sides or cubes. For example, lower substructure box 42 may be a rectangular prism having long side 45 parallel to V-door side 58 of drill rig floor 30, a cube with equal length sides, a rectangular prism with a square base, or long side 45 perpendicular to V-door side 58 of drill rig floor 30. Upper substructure boxes 44 may be positioned atop lower substructure box 42 with gap 43 between upper substructure boxes 44. Upper substructure boxes 44 may be rectangular prisms having long sides or cubes. Gap 43 may be sized such that robotic pipe handler (RPH) 80 may articulate between upper substructure boxes 44 or such that the RPH may pass pipe 130 through gap 43. Beams 36 may be positioned atop upper substructure boxes 44 and may be pinned or welded.

In some embodiments, RPH 80 may be omitted and a powered catwalk may be included. The powered catwalk may include a ramp that passes through gap 43 to allow for pipe 130 delivery to drill rig floor 30 when drill rig floor 30 is at the furthest well row.

In certain embodiments, RPH 80 may be affixed to V-door side 58 of drill rig floor 30. RPH 80 may be adapted to retrieve pipe 130 from a position on the ground and move pipe 130 to racker 76. Articulating portion 84 of RPH 80 may pass through gap 43 during articulation, such as when moving pipe 130 to racker 76.

Figure 7:
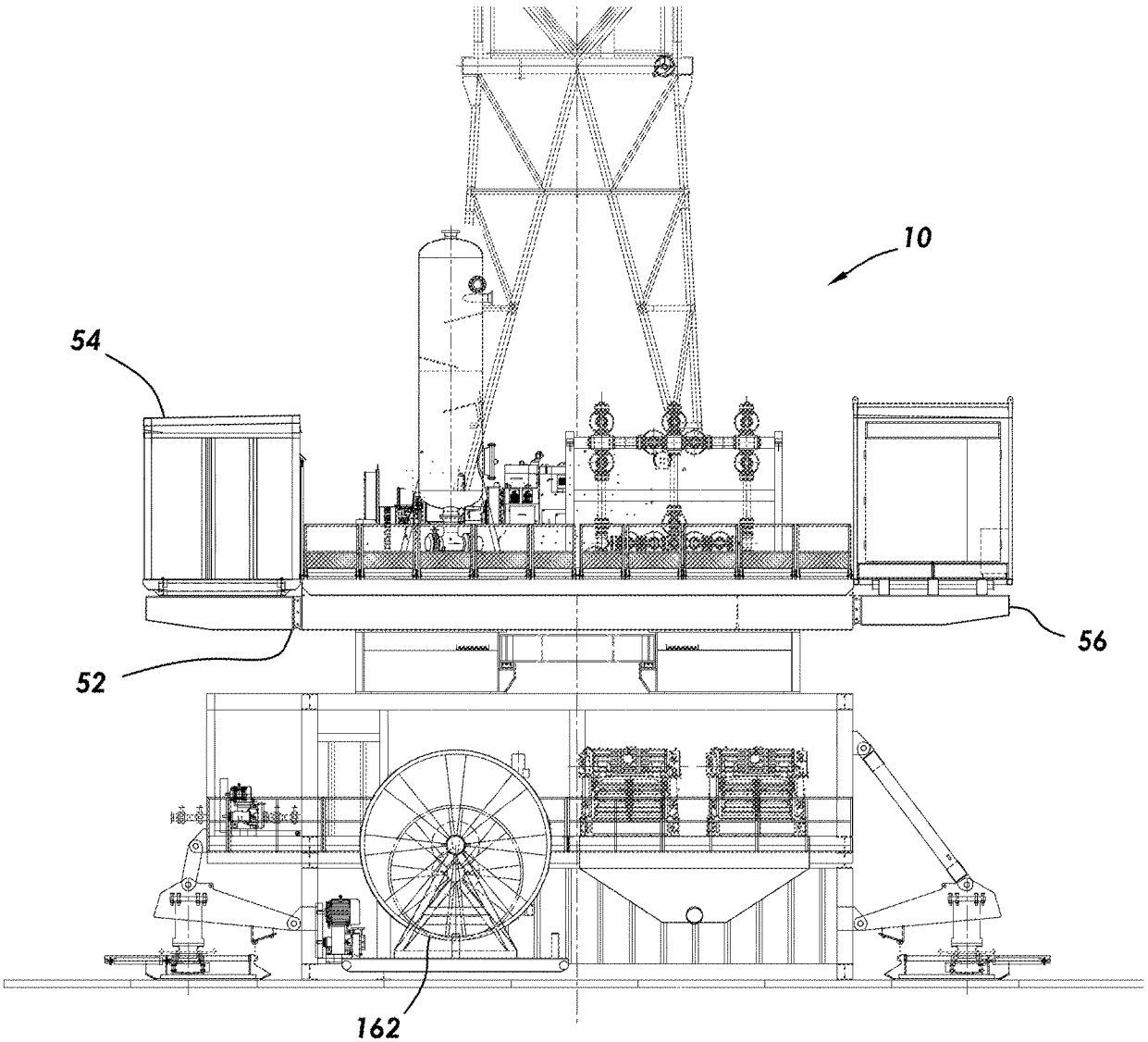
FIG. 7 is a drawworks side elevation of a land-based drilling rig consistent with at least one embodiment of the present disclosure.

In the embodiments shown in FIGS. 3, 7, and 8, land-based drilling rig 10 may include one or more hydraulic walkers 120. Hydraulic walkers 120 may be cantilevered from substructure boxes 40 or positioned within substructure boxes 40. In some embodiments, hydraulic walkers 120 may be hydraulically actuatable to move or walk land-based drilling rig 10 to a different location in the wellsite. In some embodiments, hydraulic walkers 120 may be operable to move or walk land-based drilling rig 10 along well cellars 12, where the wells of well cellars 12 are arranged in rows perpendicular to beams 36 of subfloor 35 of land-based drilling rig 10.

As shown in FIGS. 8 and 9, in certain embodiments, drill rig floor 30 may support one or more pieces of drilling rig equipment mechanically coupled, such as direct mechanical coupling, to drill rig floor 30, including one or more of, for example and without limitation, mud gas separator 150, choke manifold 152, accumulator 154, driller's cabin 54, drawworks 156, air winch 158, and man rider wrench 160. In some embodiments, additional equipment including, for example and without limitation, mud tanks, trip tanks, process tanks, mud process equipment, compressors, variable frequency drives, or drill line spoolers, may be coupled to land-based drilling rig 10. In some embodiments, equipment coupled to land-based drill rig 10, including, for example and without limitation cable reel 162, may travel with land-based drilling rig 10 as it moves through the wellsite.

In certain embodiments, certain equipment may be located within substructure boxes 40. Such equipment may include, but not be limited to shakers 170, degasser 172, and stripping tank 174.

In the embodiments shown in FIG. 6, BOP test apparatus 200 may be part of land-based drilling rig 10. BOP test apparatus may include BOP test stump skid 210 and BOP test stump cart 220. In the embodiment shown in FIG. 6, BOP test stump cart 220 may include rollers so as to traverse BOP test stump skid 210. BOP test stump skid 210 may be affixed to substructure boxes 40.

In some embodiments, as shown in FIG. 3, land-based drilling rig 10 may include BOP rails 230. BOP rails 230 may be coupled to the underside of drill rig floor 30 or subfloor 35. BOP 235, shown in FIG. 2, may be mechanically coupled to BOP trolley 240. BOP trolley 240 may support BOP 235 and may, in some embodiments, include a hoist or other apparatus adapted to allow BOP 235 to be raised or lowered. BOP trolley 240 may be operatively coupled to BOP rails 230 such that, when BOP 235 is supported by BOP trolley 240, BOP 235 may be moved relative to drill rig floor 30 or subfloor 35 such as, for example and without limitation, between wells positioned in left well cellar 13 and right well cellar 14.

One having ordinary skill in the art with the benefit of this disclosure will understand that the specific configurations depicted in the figures may be varied without deviating from the scope of this disclosure.

Those skilled in the art will appreciate that numerous changes and modifications can be made to the preferred embodiments of the present disclosure and that such changes and modifications can be made without departing from the spirit of said disclosure. It is, therefore, intended that the appended claims cover all such equivalent variations as fall within the true spirit and scope of said disclosure.

What is claimed is:

1. A land-based drilling rig comprising:

a drill rig floor, the drill rig floor having a V-door, the V-door defining a V-door side of the drill rig floor;

a subfloor, the subfloor supporting the drill rig floor, wherein the drill rig floor is movable relative to the subfloor and thereby is adapted to traverse atop the subfloor;

a plurality of substructure boxes, the substructure boxes supporting the subfloor, each substructure box including a lower substructure box and two upper substructure boxes, wherein there is a gap between the two upper substructure boxes and wherein the lower substructure box is a rectangular prism with the long side parallel to the V-door side of the drill rig floor that extends the length of the subfloor; and a mast, the mast mechanically coupled to the drill rig floor, the mast having an open side and having a V-door side where the V-door side of the mast faces the V-door side of the drill rig floor.

2. The land-based drilling rig of claim 1 further comprising a robotic pipe handler affixed to the V-door side of the drill rig floor.

3. The land-based drilling rig of claim 2, wherein the robotic pipe handler has an articulating portion, wherein the articulating portion is adapted to pass through the gap during articulation or the robotic pipe handler is adapted to pass a pipe through the gap.

4. The land-based drilling rig of claim 1, wherein the upper substructure boxes are rectangular prisms having long sides or are cubes.

5. The land-based drilling rig of claim 1, wherein the subfloor includes a plurality of beams, wherein the beams are positioned atop the upper substructure boxes, and rollers affixed to the plurality of beams.

6. The land-based drilling rig of claim 1, wherein the lower substructure box extends at least a portion of the length of the subfloor.

7. The land-based drilling rig of claim 1 further comprising a hydraulic walker, the hydraulic walker cantilevered from the substructure box or positioned within the substructure box.

8. The land-based drilling rig of claim 1 further comprising a mud gas separator, a choke manifold, an accumulator, a driller's cabin, an air winch, or a man rider wrench mechanically coupled to the drill rig floor.

9. The land-based drilling rig of claim 1 further comprising a mud tank, a trip tank, a process tank, mud process equipment, a compressor, a variable frequency drive, or a drill line spooler coupled to the land-based drilling rig and travelling with the drilling rig.

10. The land-based drilling rig of claim 1 further comprising a shaker, degasser, or stripping tank positioned within the substructure box.

11. The land-based drilling rig of claim 1 further comprising:

BOP rails, the BOP rails coupled to the underside of the drill rig floor or the subfloor; and a BOP trolley, the BOP trolley operatively coupled to the BOP rails.

12. A system comprising:

a wellsite, the wellsite comprising a row of left well cellars and a row of right well cellars;

a land-based drilling rig comprising:

a drill rig floor, the drill rig floor having a V-door, the V-door defining a V-door side of the drill rig floor;

a subfloor, the subfloor supporting the drill rig floor, the subfloor comprising beams;

a leftmost substructure box and a rightmost substructure box, the substructure boxes supporting the subfloor, each substructure box including a lower substructure box and two upper substructure boxes, wherein there is a gap between the two upper substructure boxes, the leftmost substructure box positioned to the left of a left cellar and the rightmost substructure box positioned to the right of the right cellar, the rows of well cellars perpendicular to the beams and wherein the lower substructure box is a rectangular prism extending the length of the subfloor with the long side parallel to the V-door side of the drill rig floor; and a mast, the mast mechanically coupled to the drill rig floor, the mast having an open side and having a V-door side where the V-door side of the mast faces the V-door side of the drill rig floor, wherein the drill rig floor is movable relative to the subfloor for positioning of the mast above one of the well cellars.

13. The land-based drilling rig of claim 12 further comprising a robotic pipe handler affixed to the V-door side of the drill rig floor.

14. The land-based drilling rig of claim 13, wherein the robotic pipe handler has an articulating portion, wherein the articulating portion is adapted to pass through the gap during articulation.

* * * * *